US007029161B1

(12) United States Patent
Lin

(10) Patent No.: US 7,029,161 B1
(45) Date of Patent: Apr. 18, 2006

(54) INTERNAL SLEEVE IN A DOUBLE-LAMP SOCKET

(76) Inventor: Mei-Lu Lin, P.O. Box 697, Feng-Yuan City, Taichung Hsien (TW) 420

( * ) Notice: Subject to any disclaimer, the term of this patent is extended or adjusted under 35 U.S.C. 154(b) by 171 days.

(21) Appl. No.: 10/821,990

(22) Filed: Apr. 12, 2004

(51) Int. Cl.
*H01R 33/01* (2006.01)
*F21S 13/14* (2006.01)

(52) U.S. Cl. ..... 362/654; 362/644; 362/653; 362/252

(58) Field of Classification Search ..... 362/640, 362/644, 647, 652, 653, 654, 655, 656, 234, 362/249, 252, 378, 353, 435, 437, 443, 806
See application file for complete search history.

(56) References Cited

U.S. PATENT DOCUMENTS 5,839,820 A * 11/1998 Huang ..... 362/252
5,938,314 A * 8/1999 Lin ..... 362/249

* cited by examiner

*Primary Examiner*—John Anthony Ward
*Assistant Examiner*—Bao Q. Truong

(57) ABSTRACT

An internal sleeve in a double-lamp socket includes a tubular socket having a through hole in middle periphery abutting a longitudinal slot in upper portion, a pair of hooks each facing a block plate on lower opposing peripheries to define a pair of gaps therebetween, a common contact plate disposed in an inlaid groove in an inner periphery, an internal sleeve disposed in an upper inlaid groove, a pair of first and second contact plates from a pair of electric wires respectively engaged within a concave of the internal sleeve and a lower inlaid groove in the socket and a pair of first and second lamps inserted into the top and the bottom of the socket each having a pair of lead-in wires respectively engaged with the common contact plate and the first and second contact plate. Wherein the first lamp has an inverse L-shaped stop plate engaged within the slot and the second lamp has a pair of L-shaped stop plates respectively engaged within the gaps. Thereby, a series circuit is constituted inside the socket.

6 Claims, 9 Drawing Sheets

INTERNAL SLEEVE IN A DOUBLE-LAMP SOCKET

BACKGROUND OF THE INVENTION

The present invention relates to Christmas lights and more particularly to an internal sleeve in a double-lamp socket.

Convent Christmas light or a network reticulated with strings of Christmas lights are the structure of one socket with a single lamp that is somewhat too monotonous and can not present its beautification. Therefore, this structure of Christmas light is gradually going out of fashion. The applicant, faces up to such tendency, has filed several patent applications of one socket with two lamps for attempting to intensify the brightness and double-direction arrangement for the Christmas light. However, the double-direction arrangement may lead to parallel connection electric circuit that causes the reduction of the brightness for the lamps or that one of the lamps lightens and the other puts out. To improve this disadvantage, the electric circuit in the socket for two lamps should be in series connection which may keep the two lamps simultaneously lightened in same brightness. Besides, the contact plate in the socket should be stable to insure a perfect connection of the electric current.

SUMMARY OF THE PRESENT INVENTION

The present invention has a main object to provide an internal sleeve in a double-lamp socket in which the electric circuit is of series connection to enable the two lamps simultaneously lightened in same brightness without decreasing their luminosity.

Another object of the present invention is to provide an internal sleeve in a double-lamp socket in which the internal sleeve insures the stability of the contact plate that enables a perfect connection of the electric current.

Accordingly, the internal sleeve in a double-lamp socket of the present invention comprises a tubular socket having a through hole in a middle periphery, a pair of upper lamp and lower lamp respectively engaged within the upper and lower opening thereof, an inlaid groove and an elongate inlaid groove symmetrically formed in the upper inner peripheries, another inlaid groove formed in a lower inner periphery a pair of hooks in cooperation with a pair of stop plates on the opposing lower outer peripheries, an elongate common contact plate engaged with the elongate inlaid groove, at least an internal sleeve inserted into the inlaid groove in the upper portion of the socket including a guide groove, a concave and a pair of stop blocks which stop against the inlaid groove, an upper electric wire engaged within the guide groove having a contact plate inlaid in the concave of the internal sleeve, a lower electric wire having a contact plate inlaid into the lower inlaid groove, Both the electric wires pierced out via the through hole of the socket. Upon the above arrangement, the electric current through the contact plate of the upper electric wire lightens the upper lamp and simultaneously transmits to the lower lamp via the common contact plate and then flows out through the lower electric wire and its contact plate, so as to achieve a series connection of the electric circuit between the two lamps which are simultaneously lightened in same brightness.

The present invention will become more fully understood by reference to the following detailed description thereof when read in conjunction with the attached drawings.

DETAILED DESCRIPTION OF THE PREFERRED EMBODIMENT

Figure 1:
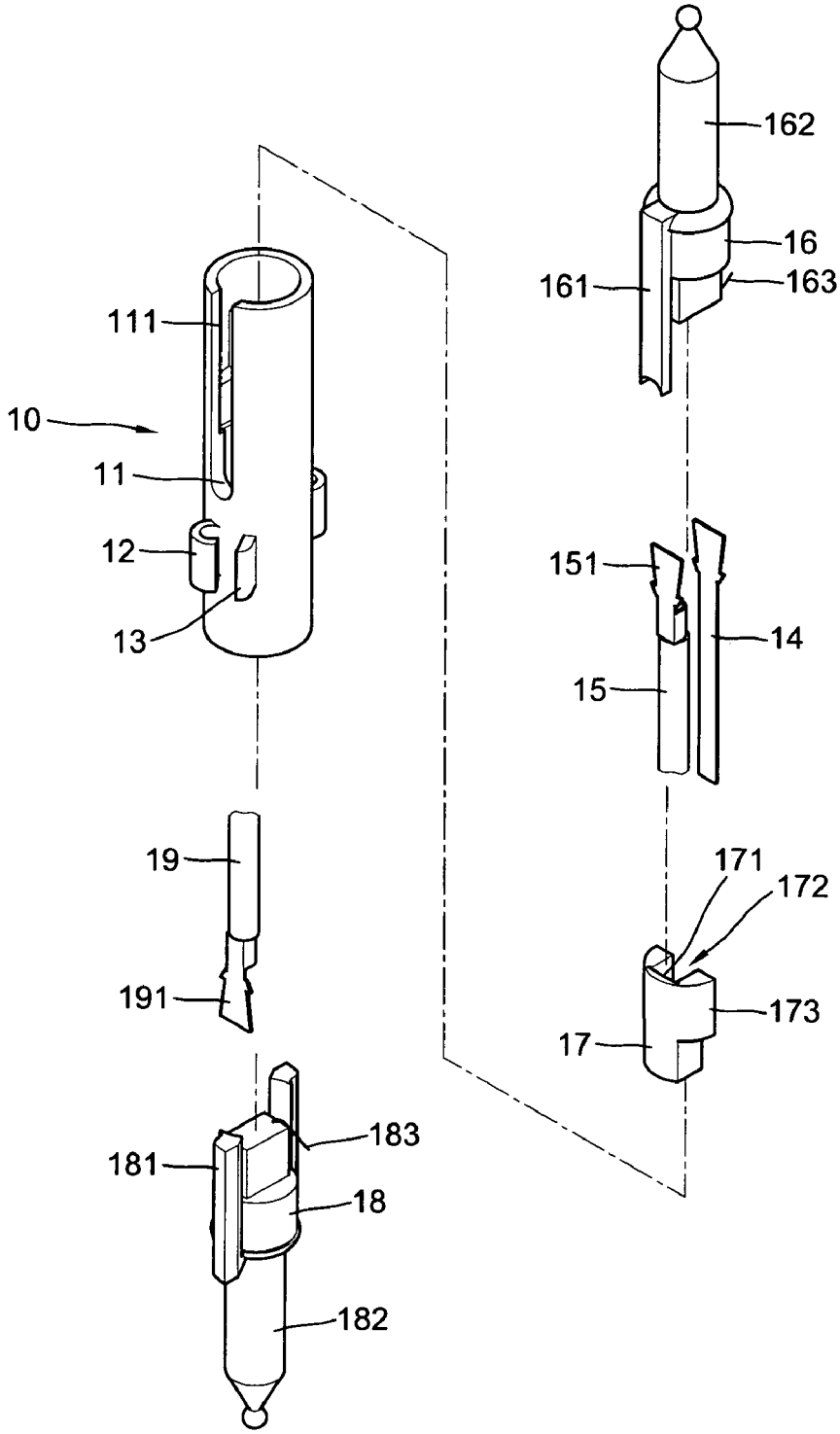
FIG. 1 is an exploded perspective view to show a first embodiment of the double-lamp socket of the present invention.
Figure 2:
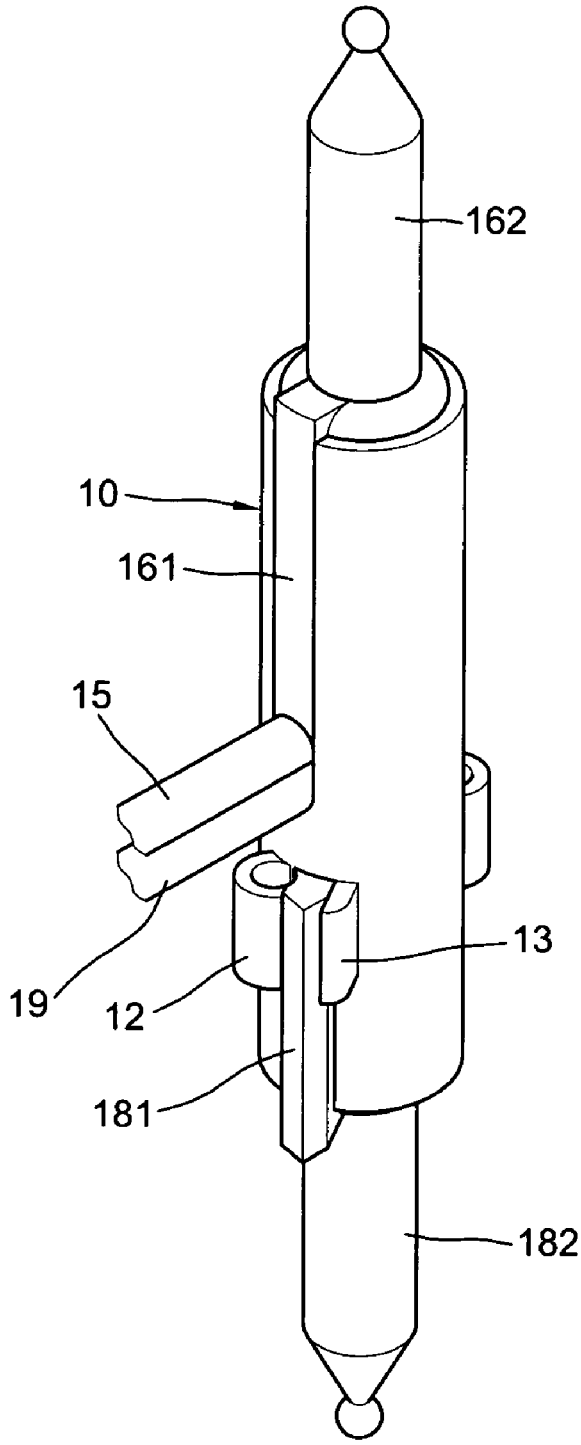
FIG. 2 is a perspective view to show the assembly of FIG. 1.
Figure 4:
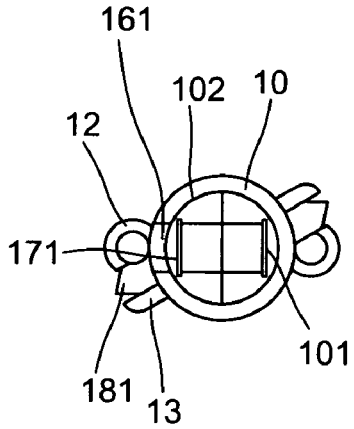
FIG. 4 is a top view of FIG. 2.
Figure 3:
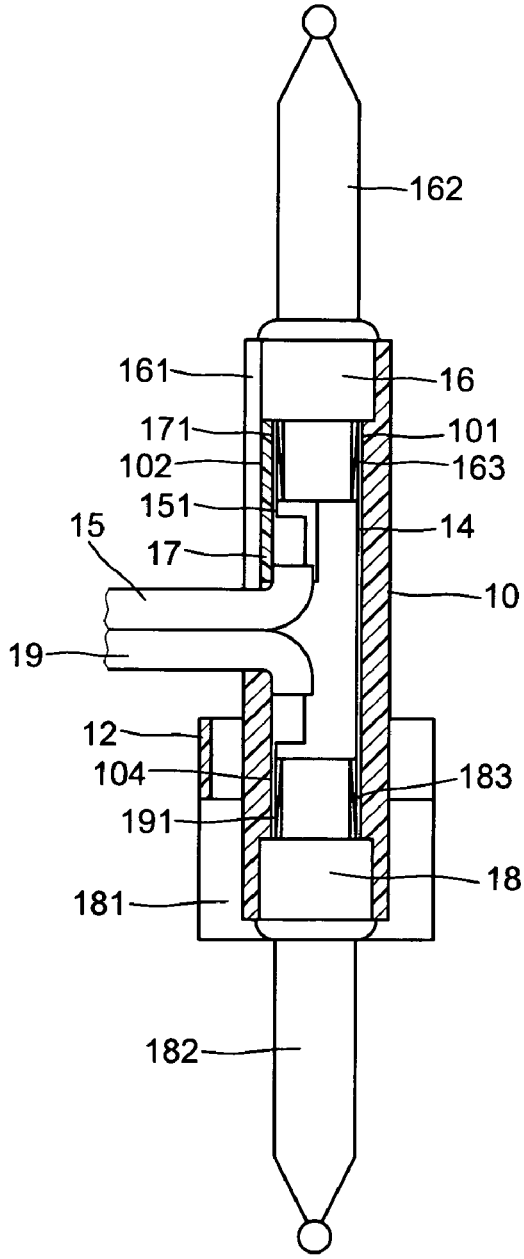
FIG. 3 is a section view of FIG. 2.
Figure 5:
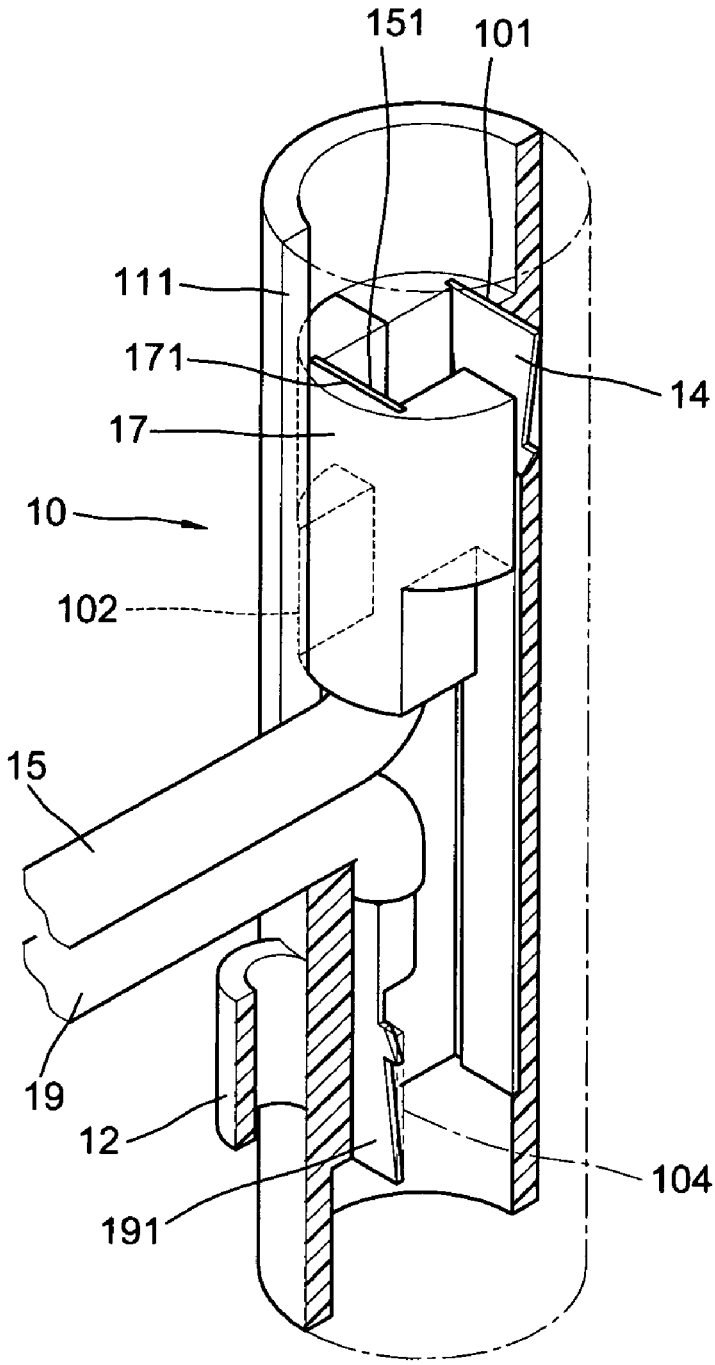
FIG. 5 is a semi-sectional view of FIG. 2.
Figure 6:
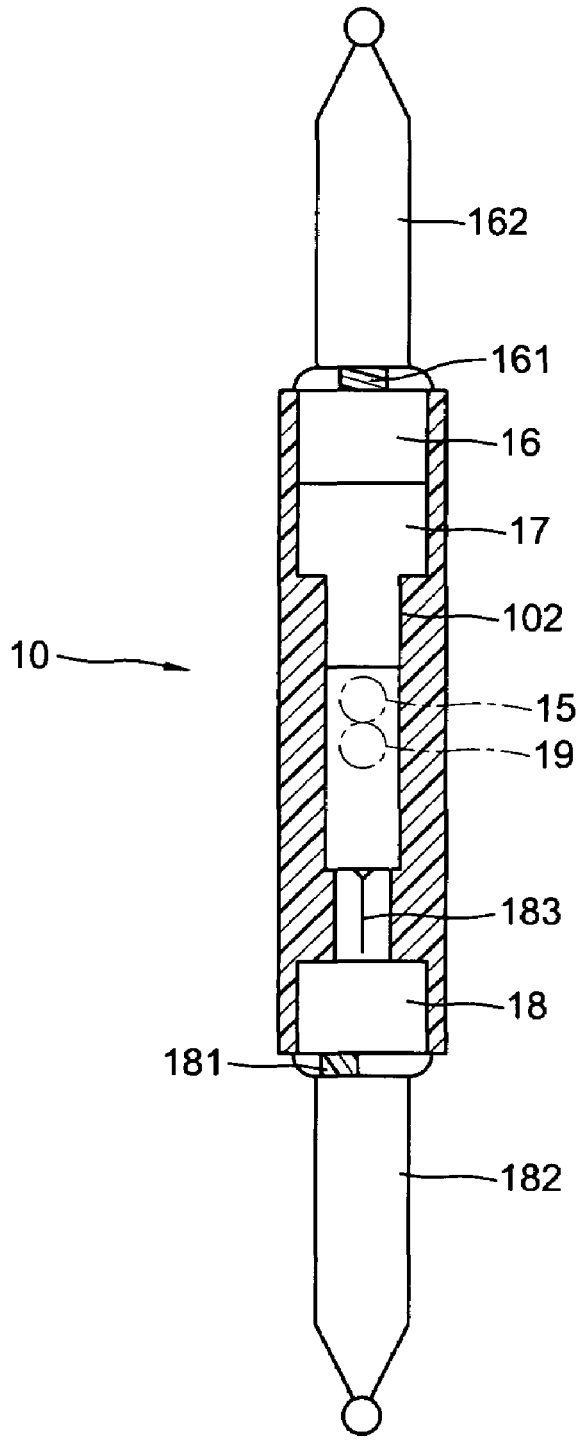
FIG. 6 is a longitudinal section of FIG. 2.

With reference to FIGS. 1 to 7 of the drawings, the first embodiment of the internal sleeve in a double-lamp socket of the present invention comprises a tubular socket 10 having a through hole 11 in a middle periphery communicating to a longitudinal slot 111 in upper periphery, a pair of hooks 12 symmetrically formed on the opposing lower outer peripheries each facing a block plate 13 so as to define a pair of gaps there-between, an elongate inlaid groove 101 and a short inlaid groove 102 symmetrically formed in the opposing upper inner peripheries and a short inlaid groove 104 in a lower inner periphery under the short inlaid groove 102.

A common contact plate 14 disposes within the elongate inlaid groove 101 of the socket 10.

An internal sleeve 17 disposes within the short inlaid groove 102 and has a concave 171 in a guide groove 172 and a pair of lateral sides 173 stopped against the lateral walls of the short inlaid groove 102.

A first electric wire 15 inserts into the internal sleeve via the through hole 11 and has a contact plate 151 inlaid into the concave 171 of the internal sleeve 17.

A second electric wire 19 inserts into the socket 10 via the through hole either and has a contact plate 191 inlaid into the short inlaid groove 104.

A first lamp 16 inserts into an upper opening of the socket 10 and has an inverse L-shaped stop plate 161 engaged within the longitudinal slot 111 of the socket, a bulb 162 on the top and a pair of lead-in wires 163 attached on two lateral side of the base respectively engaged with the common contact plate 14 and the contact plate 151 of the electric wire 15.

A second lamp 18 inserts into a lower opening of the socket 10 and has a pair of L-shaped stop plates 181 respectively blocked the gaps between the hooks 12 and the block plates 13, a bulb 182 on the bottom and a pair of lead-in wires 183 attached to the lateral sides of the base respectively engaged with the common contact plate 14 and the contact plate 191 of the electric wire 19.

When the electric current comes from the first electric wire 15, it will transmit into the first lamp 16 via the contact plate 151 and one of the lead-in wire 163 and continuously transmit into the second lamp 18 via the another lead-in wrier 163 of the first lamp 16, the common contact plate 14 and one of the lead-in wire 183 of the second lamp and then transmit the electric current out of the socket 10 via the contact plate 191 of the second electric wire 19 and the other one lead-in wrier 183 of the second lamp 18. So that a series circuit is therefore constituted inside the socket 10 by which the bulbs 162 and 182 will be simultaneously enlightened in the same brightness and the internal sleeve 17 insures the stability of the contact plate 151 and the first electric wire 15.

Figure 7:
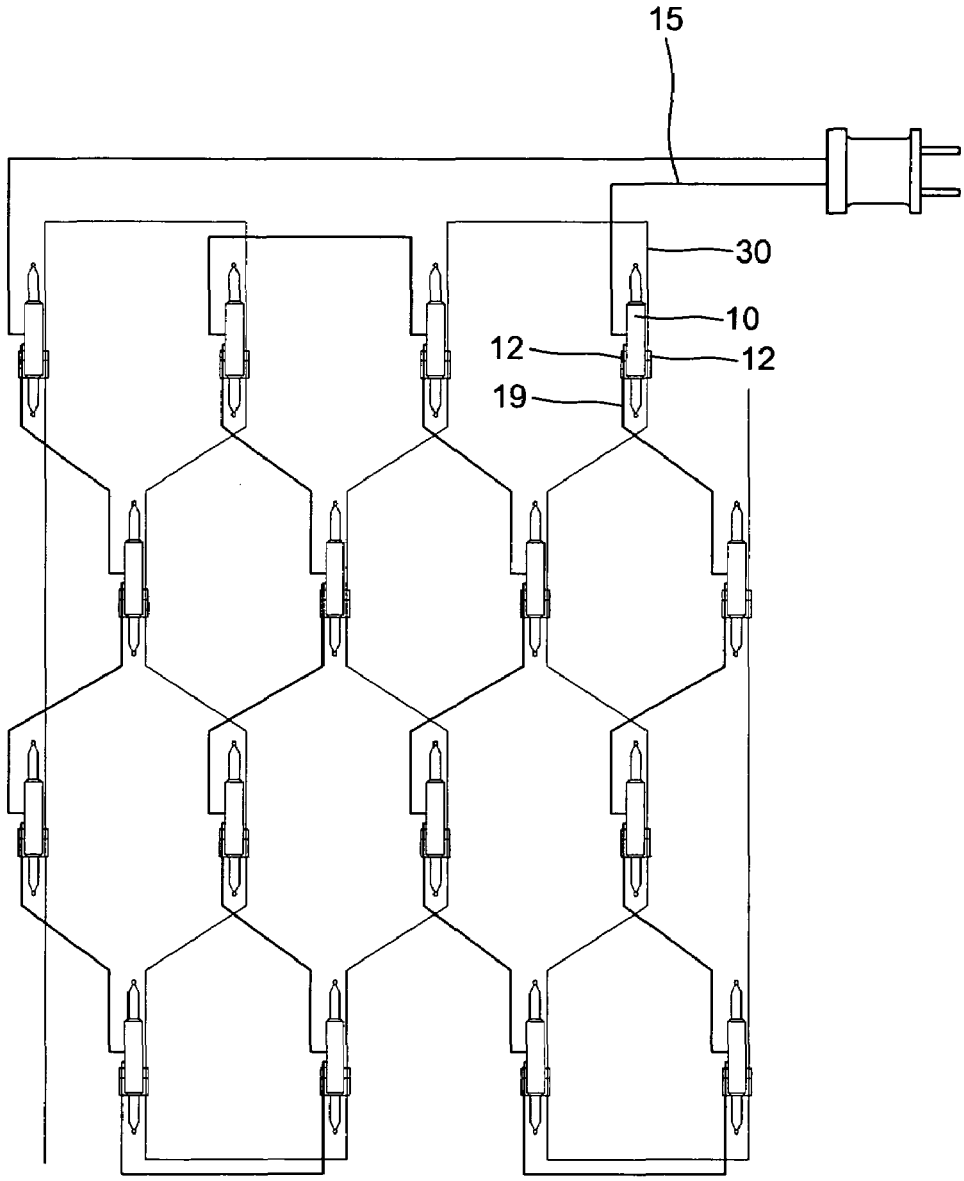
FIG. 7 is a plane view to show a network of Christmas lights reticulated by the double-lamp socket of the present invention.

This type of double-lamp socket is capable of making a string of Christmas light and/or reticulating into a network of the Christmas lights (as shown in FIG. 7) by hooking the second electric wire 19 into one of the hooks 12 and hooking a non-conductive wire 30 into another hook 12. The non-conductive wire 30 is useful to connect the adjacent socket 10 to intensity the pulling force of the network and the first and second electric wires 15 and are able to constitute a series circuit in a network of Christmas lights.

Figure 8:
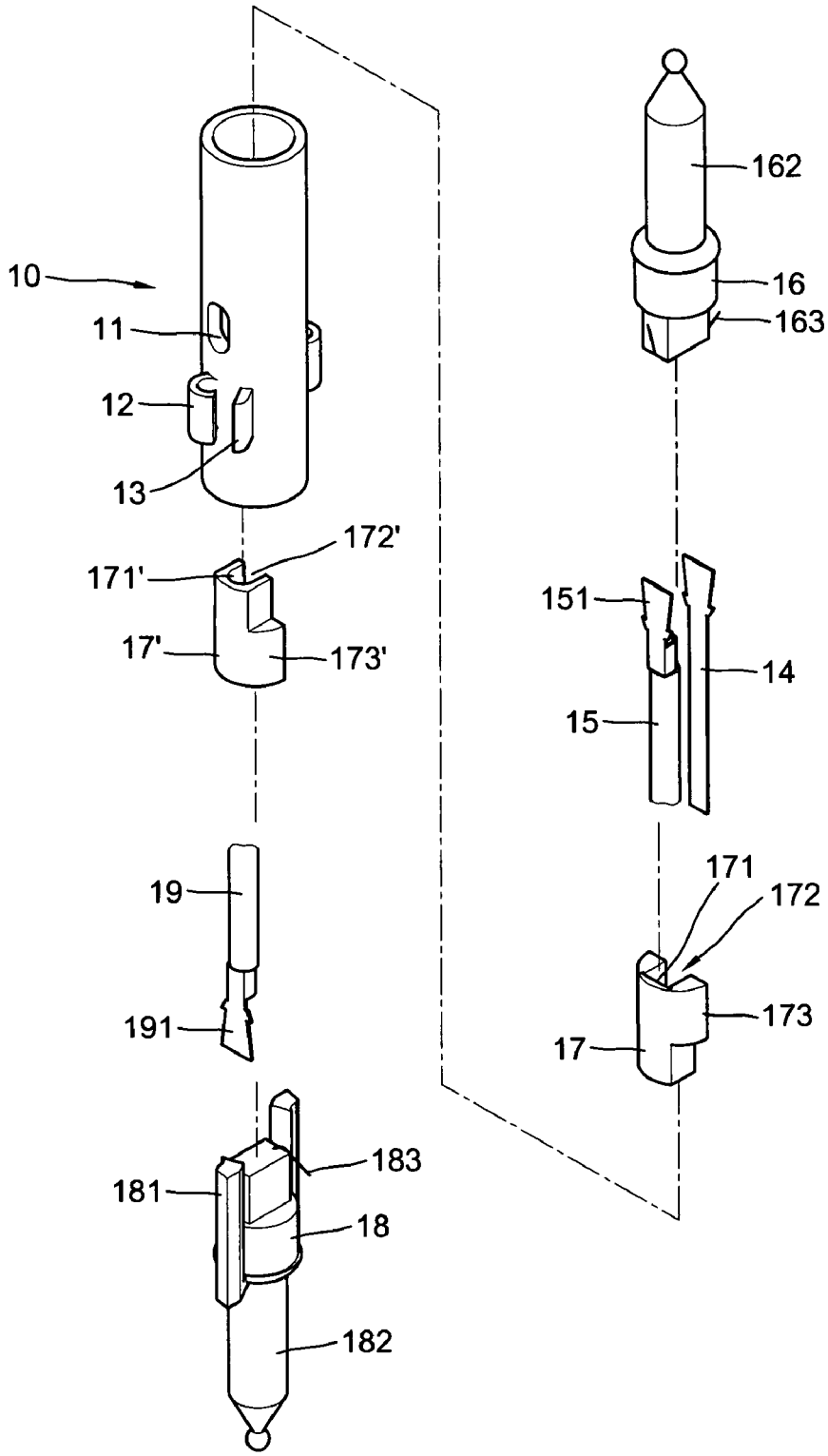
FIG. 8 is an exploded perspective view to show a second embodiment of the double-lamp socket of the present invention.
Figure 9:
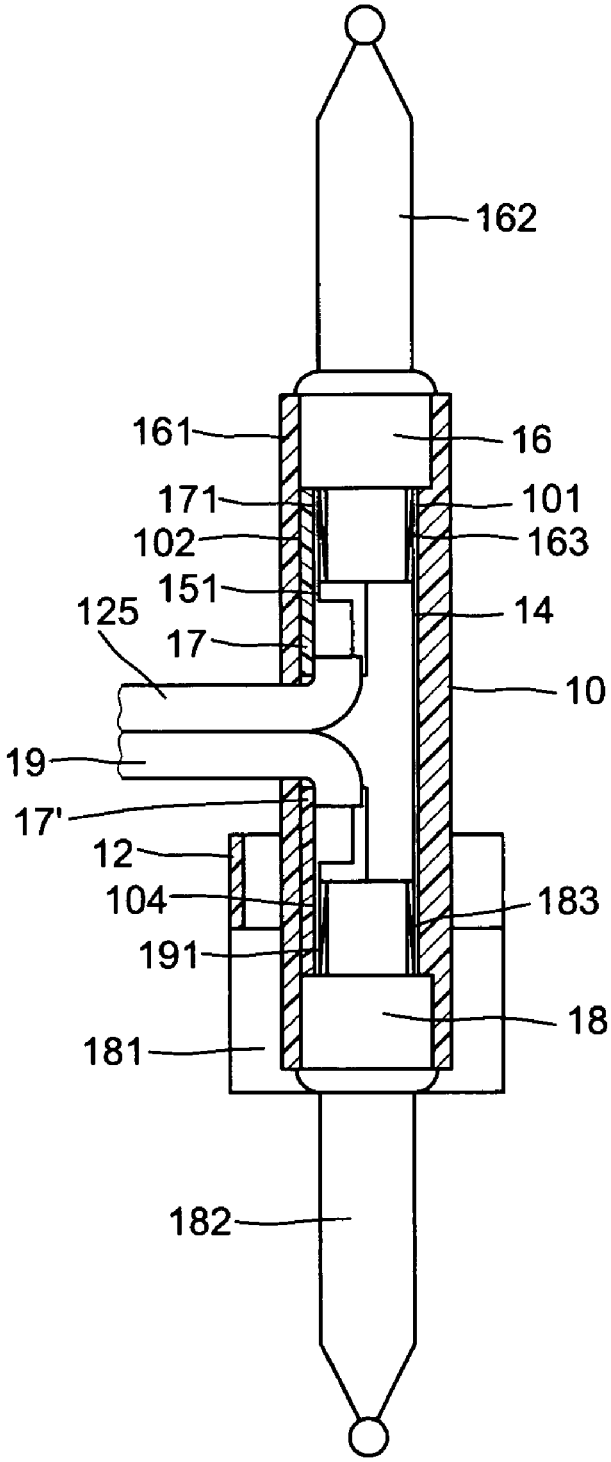
FIG. 9 is an assembly view of FIG. 8.
Figure 10:
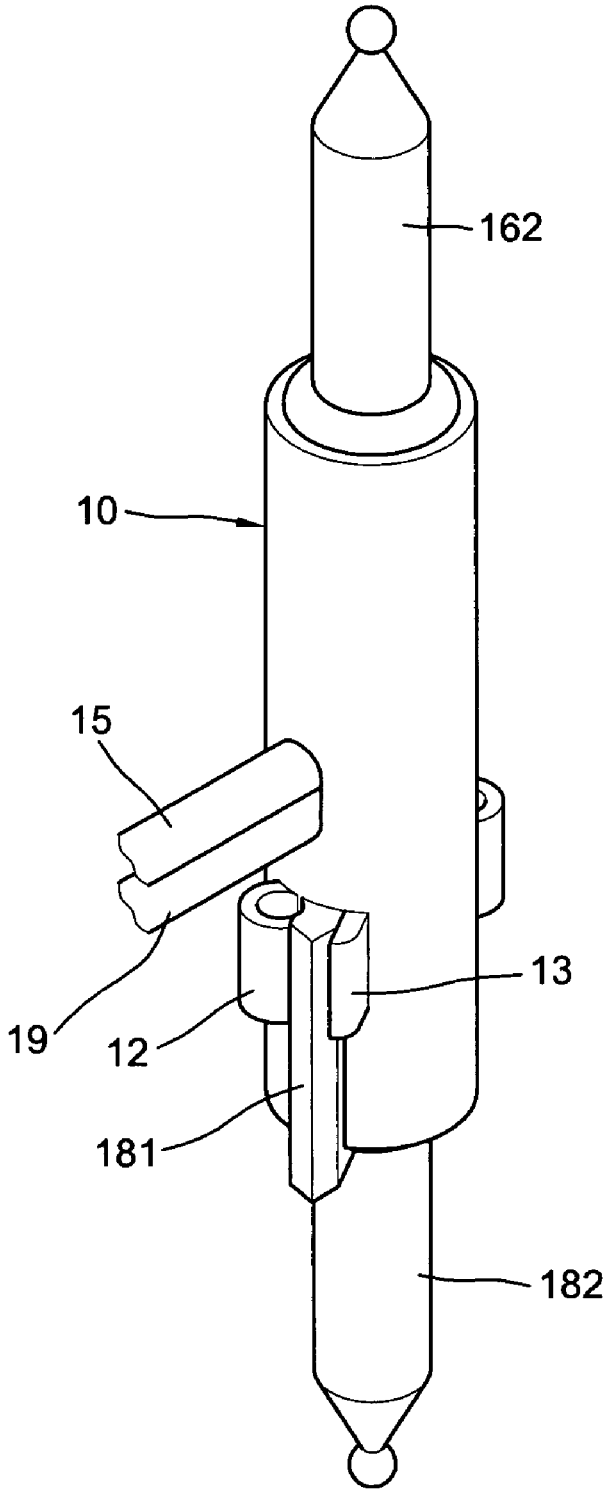
FIG. 10 is a perspective view of FIG. 9.

Referring to FIGS. 8, 9 and 10, a second embodiment of the double-lamp socket of the present is provided. This embodiment is structurally and functionally most similar to that of the first embodiment and the above discussions are applicable in most instances. The only modifications are that both of the longitudinal slot 111 in the socket 10 and the L-shaped stop plate 161 of the first lamp 16 are omitted and an additional internal sleeve 17' is added and disposed inside the short inlaid groove 104 in the lower portion of the socket 10 positioned opposite to the internal sleeve 17. The additional internal groove 17' has also a concave 171' in a guide groove 172' for disposing the contact plate 191 and the electric wire 19 and a pair of the lateral sides 173' stopped against the side walls of the short inlaid groove 104.

The second embodiment is also constituted a series circuit inside the socket 10 and is capable of making a string of Christmas lights and or reticulating a network of Christmas lights by adding a non-conductive wire 30. Further, an additional internal sleeve 17' insures more stability of the contact plate 191 but not affects the brightness of the bulbs 162 and 182.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. An internal sleeve in a double-lamp socket comprising:

a tubular socket having an upper opening, a lower opening, a through hole in a middle periphery communicating to a longitudinal slot in upper periphery, a pair of hooks each facing a block plate symmetrically formed on lower opposing outer peripheries so as to define a pair of gaps therebetween, an elongate inlaid groove and a first short inlaid groove symmetrically formed in upper opposing inner peripheries and a second short inlaid groove in a lower inner periphery under said first short inlaid groove;

a common contact plate disposed in said elongate inlaid groove of said socket;

an internal sleeve disposed in said first short inlaid groove and having a concave in a guide groove and a pair of lateral sides stopped against a pair of lateral walls of said first short inlaid groove;

a first electric wire inserted into said internal sleeve via said through hole and having a first contact plate inlaid into said concave of said internal sleeve;

a second electric wire inserted into said socket via said through hole and having a second contact plate inlaid into said second short inlaid groove;

a first lamp inserted into the upper opening of said socket and having an inverse L-shaped stop plate on one side of a base engaged within said longitudinal slot, a first bulb on top and a pair of lead-in wires attached to lateral side of said base respectively engaged with said common contact plate and said first contact plate;

a second lamp inserted into the lower opening of said socket and having a pair of L-shaped stop plates symmetrically formed on opposing outer peripheries of a base respectively engaged within said gaps, a second bulb on lower end and a pair of lead-in wires attached to lateral sides of said base respectively engaged with said common contact plate and said second contact plate;

whereby, a series circuit is therefore constituted inside said socket.

2. The internal sleeve as recited in claim 1, wherein said hooks are provided to hook said electric wires and a non-conductive wire.

3. The internal sleeve as recited in claim 1, wherein said double-lamp sockets are capable of making a string of Christmas lights and/or a network of Christmas lights by adding a non-conductive wire therein.

4. An internal sleeve in a double-lamp socket comprising:

a tubular socket having an upper opening, a lower opening, a through hole in a middle periphery, a pair of hooks each facing a block plate symmetrically formed on lower opposing peripheries so as to define a pair of gaps therebetween, an elongate inlaid groove and a first short inlaid groove symmetrically formed in upper opposing inner peripheries, and a second short inlaid groove in a lower inner periphery under said first short inlaid groove;

a common contact plate disposed in said elongate inlaid groove of said socket;

a pair of first and second internal sleeves of same structure symmetrically and respectively disposed into said first and second short inlaid grooves each having a concave in a guide groove and a pair of lateral sides stopped against a pair of lateral walls of said short inlaid grooves;

a first electric wire inserted into said socket via said through hole and having a first contact plate inlaid into said concave of said first internal sleeve;

a second electric wire inserted into said socket via said through hole and having a second contact plate inlaid into said concave of said second internal sleeve;

a first lamp inserted into the upper opening of said socket and having a bulb on top and a pair of lead-in wires attached on lateral sides of a base respectively engaged with said common contact plate and said first contact plate;

a second lamp inserted into the lower opening of said socket and having a bulb on lower end of a base, a pair of L-shaped stop plates respectively engaged within said gaps and a pair of lead-in attached on lateral sides of said base respectively engaged with said common contact plate and said second contact plate;

whereby, a series circuit is therefore constituted inside said socket.

5. The internal sleeve as recited in claim 4, wherein said hooks are provided to hook said electric wires and a non-conductive wire.

6. The internal sleeve as recited in claim 4, wherein said double-lamp sockets a capable of making a string of Christmas lights and/or a network of Christmas lights by adding a non-conductive wire therein.

* * * * *